US006225961B1

(12) United States Patent
Benjauthrit

(10) Patent No.: US 6,225,961 B1
(45) Date of Patent: May 1, 2001

(54) BEAM WAVEGUIDE ANTENNA WITH INDEPENDENTLY STEERABLE ANTENNA BEAMS AND METHOD OF COMPENSATING FOR PLANETARY ABERRATION IN ANTENNA BEAM TRACKING OF SPACECRAFT

(75) Inventor: Boonsieng Benjauthrit, La Canada, CA (US)

(73) Assignee: PRC Inc., McLean, VA (US)

( * ) Notice: Subject to any disclaimer, the term of this patent is extended or adjusted under 35 U.S.C. 154(b) by 0 days.

(21) Appl. No.: 09/361,355

(22) Filed: Jul. 27, 1999

(51) Int. Cl.[7] ..... H01Q 19/10

(52) U.S. Cl. ..... 343/839; 343/781 CA; 455/13.3; 342/359

(58) Field of Search ..... 455/13.3, 562, 455/12.1; 343/781 CA, 839, 840, 757, 758, 761; 342/350, 352, 354, 357, 358, 359

(56) References Cited

U.S. PATENT DOCUMENTS

| | | | |
|---|---|---|---|
| 3,688,311 | 8/1972 | Salmon . | |
| 3,696,436 | 10/1972 | Yokoi et al. . | |
| 3,792,480 | 2/1974 | Graham . | |
| 3,821,746 | 6/1974 | Mizusawa et al. . | |
| 3,845,483 | 10/1974 | Soma et al. . | |
| 3,950,079 | 4/1976 | Rambauske . | |
| 4,044,361 | 8/1977 | Yokoi et al. . | |
| 4,062,018 | 12/1977 | Yokoi et al. . | |
| 4,145,695 | 3/1979 | Gans . | |
| 4,491,848 | 1/1985 | Dragone . | |
| 4,525,719 | 6/1985 | Sato et al. . | |
| 4,559,540 | 12/1985 | Betsudan et al. . | |
| 4,631,545 | 12/1986 | Dragone . | |
| 4,777,491 | 10/1988 | Bassi et al. . | |
| 5,563,606 * | 10/1996 | Wang | 342/354 |
| 5,668,556 * | 9/1997 | Rouffet et al. | 342/354 |
| 5,673,057 * | 9/1997 | Toland et al. | 343/761 |
| 5,761,605 * | 6/1998 | Tawil et al. | 455/3.2 |
| 5,765,098 * | 6/1998 | Bella | 455/13.3 |
| 5,808,732 * | 9/1998 | Williams | 356/139.01 |

* cited by examiner

*Primary Examiner*—Michael C. Wimer
*Assistant Examiner*—Ephrem Alemu
(74) *Attorney, Agent, or Firm*—Lowe Hauptman Gilman & Berner, LLP

(57) ABSTRACT

An antenna assembly for forming and directing a transmit beam, and for controlling receive and transmit beam tracking of a spacecraft in the presence of planetary aberration. The assembly includes a main reflector, a sub-reflector centered along an optical axis of the main reflector, and a moveable transmit feed for directing electromagnetic radiation along a longitudinal axis thereof. The assembly also includes an intermediate beam waveguide assembly arranged between the moveable transmit feed and the main reflector, wherein the intermediate beam waveguide assembly includes fixed and moveable optical components for guiding electromagnetic beam energy between the moveable transmit feed and the main reflector. A beam steering mechanism is coupled with the moveable transmit feed for angularly displacing the transmit beam from the optical axis by displacing the moveable transmit feed in a direction substantially orthogonal to the longitudinal axis of the transmit feed.

14 Claims, 10 Drawing Sheets

FIG. 7
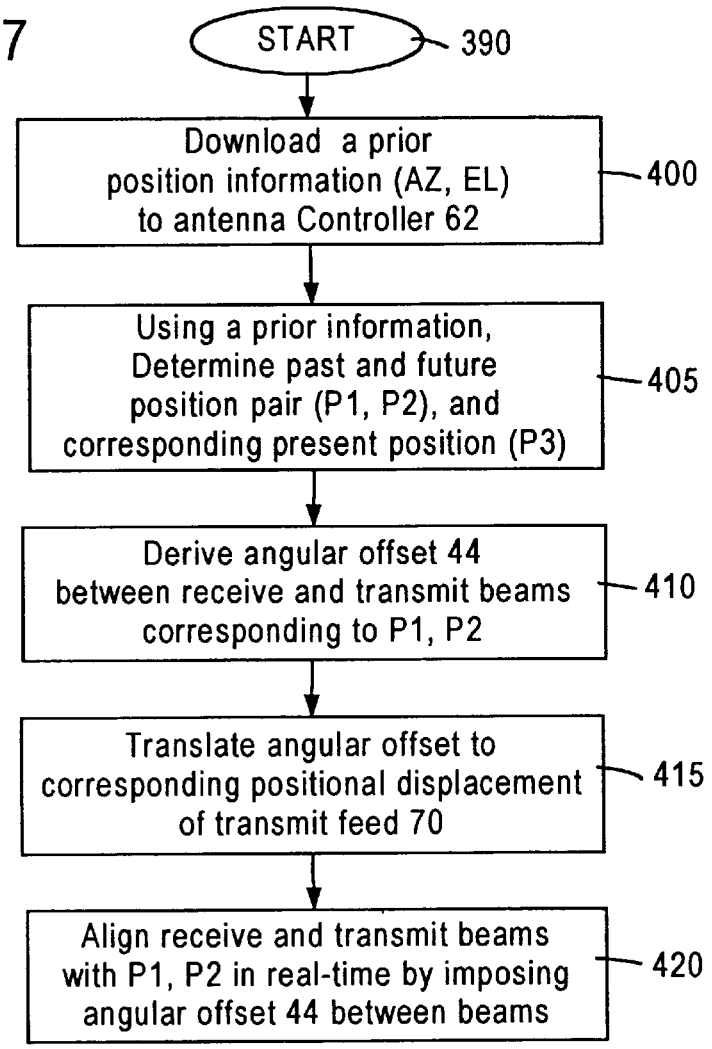
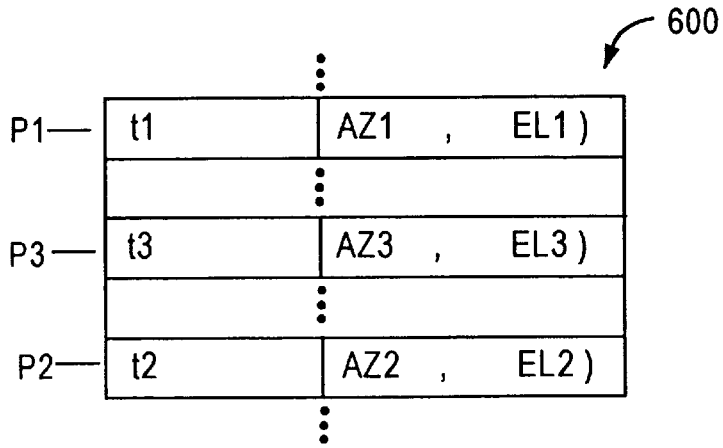
FIG. 8

BEAM WAVEGUIDE ANTENNA WITH INDEPENDENTLY STEERABLE ANTENNA BEAMS AND METHOD OF COMPENSATING FOR PLANETARY ABERRATION IN ANTENNA BEAM TRACKING OF SPACECRAFT

FIELD OF THE INVENTION

The present invention generally relates to a terrestrial beam waveguide antenna and, more particularly, to such an antenna forming a transmit beam, wherein the transmit beam is independently steerable with respect to a receive beam formed by the antenna.

The present invention also generally relates to a method of and apparatus for controlling a terrestrial beam waveguide antenna and, more particularly, to a method of and apparatus for controlling receive and transmit beams of such an antenna to compensate for planetary aberration in the beam tracking of a spacecraft.

BACKGROUND OF THE INVENTION

Terrestrial stations for spacecraft communications typically include a large aperture antenna for communicating with a spacecraft. Such an antenna typically includes a beam waveguide assembly having a main reflector and a sub-reflector centered on an optical axis of the main reflector, e.g., a Cassegrain antenna. The beam waveguide assembly forms and directs a reciprocal pair of main antenna beams along the optical axis. The main antenna beams typically include a transmit beam for transmitting an uplink signal to and a receive beam for receiving a down-link signal from the spacecraft. To track the spacecraft, the main reflector and the sub-reflector, which are fixed relative to each other and rotate together, along with other optical components of the beam waveguide assembly, are typically driven by motors and servo-mechanisms in at least two rotational directions, e.g., azimuth (AZ) and elevation (EL), so as to align the main beams with the spacecraft. In this manner, the receive and transmit beams are both aligned with the same position of the spacecraft at a given point in time.

A Cassegrain antenna of sufficiently high gain to track a distant spacecraft includes large and correspondingly heavy beam waveguide components, e.g., a main reflector thirty-five meters in diameter, thus necessitating correspondingly bulky and relatively complex motors and servo-mechanisms to rotate such heavy components. Antenna beam tracking accuracy, i.e., alignment accuracy between the main beams and a tracked spacecraft position, is critical when using such a high gain antenna because even a small alignment error, e.g., on the order of millidegrees, results in a significant reduction in peak antenna gain. This criticality is even more pronounced when the antenna is used to track an interplanetary spacecraft because a signal communicated between such a distant spacecraft and the antenna experiences substantial propagational attenuation, i.e., signal attenuation proportional to the square of the distance between the antenna and the spacecraft.

Although the conventional antenna arrangement described above may suffice for communicating with a spacecraft relatively near to the earth, e.g., occupying low, medium and high earth orbits, its use for communicating with a relatively distant, e.g., interplanetary, spacecraft is limited and problematic. Effective communication with the relatively distant spacecraft is complicated in part by a phenomenon referred to as planetary aberration—the phenomenon by which objects in space, as viewed from the earth, are not where they appear to be. Planetary aberration arises as a result of 1) a component of relative motion between the spacecraft and the antenna, specifically, a component of the spacecraft's velocity orthogonal to a line-of-site between the spacecraft and the antenna, and 2) the finite time taken for the uplink and down-link signals to travel between the spacecraft and the antenna due to the finite speed with which the signals propagate through space. The finite time taken for the uplink and down-link signals to travel round-trip between the spacecraft and the antenna is referred to as the round-trip light travel time (RTLT).

The effect of planetary aberration can be appreciated in view of an astronomical coordinate system referred to as the right ascension (RA) and declination (DEC) coordinate system. RA/DEC coordinates define a position on what is referred to as a celestial sphere. The celestial sphere is a two dimensional projection of the sky on a sphere—the celestial sphere—surrounding the earth. Planetary aberration arises because the spacecraft moves in the RA/DEC coordinate system, and thus changes its position over time on the celestial sphere as observed from a point fixed on the earth, i.e., the antenna. The spacecraft changes its RA/DEC position because of its component of orthogonal velocity, without which the spacecraft would tend to maintain a single RA/DEC position and thus move directly toward or away from the antenna.

As will become apparent from the following example, compensating for planetary aberration in the receive and transmit beam tracking of the spacecraft requires an angular separation between the receive and transmit beams. The conventional beam waveguide antenna system disadvantageously includes colinearly aligned receive and transmit beams, i.e., receive and transmit beams aligned in the same direction, and is without a mechanism for imposing such angular separation between the receive and transmit beams, i.e., for splitting the receive and transmit beams apart to compensate for planetary aberration.

The following example serves to illustrate the detrimental effect planetary aberration has on communication between the spacecraft and the colinearly aligned receive and transmit beams of the conventional antenna. Assume a spacecraft initially transmits a down-link signal from a past or previous spacecraft position, and in the finite time taken for the down-link signal to travel to the antenna, i.e., half a RTLT, the spacecraft moves to a present spacecraft position at a present time. Assume at the present time the receive beam of the antenna, along with the optical axis and transmit beam, is aligned with the past spacecraft position to receive the down-link signal arriving therefrom, and, contemporaneous with the arrival of the down-link signal, an uplink signal is transmitted from the antenna via the transmit beam. Assume also in the finite time taken for the uplink signal to arrive at the past spacecraft position, i.e., half a RTLT, the spacecraft moves from the second spacecraft position to a future spacecraft position, i.e., in one RTLT, the spacecraft moves from the past spacecraft position, through the present spacecraft position, and on to the future spacecraft position.

For a relatively near spacecraft, one RTLT is relatively short, e.g., fractions of a second, and the displacement of the spacecraft in RA/DEC coordinates between the past and future positions is negligible with respect to the beam coverage of the receive and transmit beams. Consequently, effective communication can occur even though the uplink signal is transmitted toward the past spacecraft position, and not along a direction intersecting the future spacecraft position, because both spacecraft positions are covered by the transmit beam.

On the other hand, for a relatively distant spacecraft, the one RTLT is relatively large, e.g., 160 minutes for a spacecraft near the planet Saturn, thus leading to an appreciable spacecraft displacement between the past and future spacecraft positions. In this case, the transmit beam coverage does not necessarily encompass the more widely separated positions, a situation worsened by the requirement for a highly directive, i.e., high gain, antenna beam. Without some form of correction or compensation to account for the separation of positions due to planetary aberration, signal loss can be significant, e.g., up to 25 dB. This is due to the colinear alignment of the receive and transmit beams of the antenna with past, present or future positions of the spacecraft. Consequently, ineffective communication results since the uplink signal is transmitted toward the incorrect spacecraft position (e.g., the past position), as a result of this colinear alignment of the receive and transmit beams of the antenna.

For the relatively distant spacecraft, effective communication thus requires simultaneous alignment of the downlink and uplink signals with the respective past and future positions of the spacecraft at the present time, i.e., simultaneous alignment of the receive and transmit beams with respective spaced-apart spacecraft positions coinciding with times half a RTLT previous to and half a RTLT after the present time. Conventionally, achievement of such spaced alignment disadvantageously requires two antennas—one antenna providing receive beam tracking of the past position, and the other antenna providing transmit beam tracking of the future position—because of the colinear receive and transmit beam arrangement of the conventional antenna.

Accordingly, there is a need for a high-gain beam waveguide antenna having a beam steering capability independent of and in addition to the conventional rotational mechanisms used for antenna beam steering.

There is also a need for a high-gain beam waveguide antenna having receive and transmit main beams independently steerable with respect to each other and the optical axis of the antenna.

There is a further need in a beam waveguide antenna system to control the receive and transmit beam tracking of a spacecraft moving along a space trajectory to compensate for appreciable planetary aberration.

There is an even further need for using a single antenna system forming receive and transmit beams to beam-track a spacecraft moving along a spacecraft trajectory to compensate for planetary aberration.

There is also a need to reduce the effects of propagational attenuation of a signal transmitted between a spacecraft and an antenna system.

SUMMARY OF THE INVENTION

It is therefore an object of the present invention to independently steer the transmit beam of a high-gain, beam waveguide antenna with respect to a receive beam formed by the antenna. This object also includes independently steering the transmit beam with respect to an optical axis of the antenna.

A related object of the present invention is to control independent steering of a transmit beam formed by a terrestrial, high-gain, beam waveguide antenna with respect to an optical axis of the antenna and a receive beam formed by the antenna, to compensate for appreciable planetary aberration in the receive and transmit beam tracking of a spacecraft moving along a space trajectory.

Another object of the present invention is the improvement of a conventional, high-gain, beam waveguide antenna having a conventional beam steering mechanism for steering together receive and transmit beams formed by the antenna, the improvement including the addition of a beam steering mechanism for independently steering the transmit beam with respect to the receive beam.

Another object of the present invention is to reduce the effects of propagational attenuation of a signal transmitted between a spacecraft and an antenna system.

These and other objects of the present invention are achieved through an improvement to a conventional, high-gain beam waveguide antenna system. The improved antenna system includes a beam waveguide having conventional components, including a large main reflector, a sub-reflector centered along an optical axis of the main reflector, a fixed receive feed associated with a receive beam formed by the antenna system, and an intermediate beam waveguide assembly positioned between the fixed receive feed and the main reflector for guiding beam energy there between. A conventional beam steering mechanism coupled with the main reflector and moveable components of the intermediate beam waveguide assembly steers together the optical axis of the main reflector, the receive beam and a transmit beam formed by the antenna system.

The improvement in accordance with the present invention includes a moveable transmit feed, associated with the transmit beam. Controlled displacement of the moveable transmit feed, in a planar direction perpendicular to a beam feeding axis of the transmit feed, advantageously produces a corresponding angular displacement of the transmit beam from both the optical axis and the receive beam. The improvement also includes electrically driven actuators coupled with the moveable transmit feed for controllably displacing the transmit feed responsive to a control signal derived by a beam steering controller executing beam steering control software of the present invention. Advantageously, the electrically driven actuators are small, light, readily available, and easy to control because the transmit feed is much smaller and lighter than the large main reflector. As a result, high resolution transmit beam steering, on the order of millidegrees, is easily attained with fine displacements of the moveable transmit feed using the actuators coupled thereto.

The foregoing objects of the present invention are achieved by an antenna assembly for forming and directing a transmit beam. The assembly includes a main reflector, a sub-reflector centered along an optical axis of the main reflector, and a moveable transmit feed for directing electromagnetic radiation along a longitudinal axis of the transmit feed. The assembly also includes an intermediate beam waveguide assembly positioned between the moveable transmit feed and the main reflector, wherein the intermediate beam waveguide assembly includes fixed and moveable optical components for guiding electromagnetic beam energy between the moveable transmit feed and the main reflector. A beam steering mechanism is coupled with the moveable transmit feed for angularly displacing the transmit beam from the optical axis by displacing the moveable transmit feed in a direction substantially orthogonal to the longitudinal axis of the transmit feed.

The foregoing and other objects of the present invention are achieved by a method of controlling the improved antenna of the present invention to compensate for appreciable planetary aberration in receive and transmit beam tracking of a spacecraft moving along a space trajectory. In the method, the transmit and receive beams of the improved antenna respectively transmit an uplink signal to and receive a down-link signal from the spacecraft. The down-link and uplink signals travel round-trip between the spacecraft and the antenna in one RTLT.

The method includes aligning the receive beam at a present time with a past position of the spacecraft coinciding with where the spacecraft was half a RTLT before the present time. The method includes contemporaneously aligning the transmit beam with a future position of the spacecraft coinciding with where the spacecraft will be half a RTLT after the present time. When so aligned, an angular displacement between the receive and transmit beams compensates for planetary aberration. The contemporaneous step of aligning the transmit beam includes the step of displacing the transmit feed of the antenna in a planar direction, thus angularly displacing the transmit beam from the receive beam and into alignment with the future position of the spacecraft.

The foregoing and other objects of the present invention are achieved by a method of controlling a terrestrial antenna system to compensate for planetary aberration including the steps of 1) aligning a receive beam of the antenna system at a present time with a past position of a spacecraft, and 2) aligning a transmit beam of the antenna system with a future position of the spacecraft spaced from the past position, wherein a down-link signal and an uplink signal can be simultaneously received from the past position of the spacecraft and transmitted to the future position of the spacecraft by the antenna system, respectively.

The foregoing and other objects of the present invention are achieved by a method of compensating for planetary aberration in an antenna system. The antenna system includes a beam waveguide and a transmit feed for forming and directing a transmit beam. The transmit beam is used to transfer a signal between the transmit feed and a spacecraft. The method includes angularly displacing the transmit beam from an optical axis of the beam waveguide responsive to a displacement of the transmit feed in a direction orthogonal to an axis of the transmit feed. Such displacement of the transmit feed aligns the transmit beam with a future position of the spacecraft, wherein the spacecraft moves from a present position to the future position during the approximate time taken for the transfer of the signal between the antenna system and the spacecraft.

The foregoing and other objects of the present invention are achieved by an antenna system controller for a terrestrial antenna adapted to form and direct transmit and receive beams for respectively transmitting a signal to and receiving a signal form a spacecraft. The antenna system controller includes a processor, an interface coupled to the processor, and a memory coupled to the processor. The memory stores sequences of instructions which, when executed by the processor, causes the processor to 1) identify temporally spaced first and second apriori positions of the spacecraft corresponding to a round-trip travel time of the signals between the spacecraft and the terrestrial antenna, and 2) derive an angular displacement between the receive and transmit beams to contemporaneously align the receive and transmit beams with spacecraft positions.

The above and still further objects, features and advantages of the present invention will become apparent upon consideration of the following detailed description of a specific embodiment thereof, especially when taken in conjunction with the accompanying drawings.

BRIEF DESCRIPTION OF THE DRAWINGS

FIG. 7 is a high-level flow diagram of a method used to control the antenna system of FIG. 1;

FIG. 8 is an illustration of an exemplary format for the apriori spacecraft trajectory information used in the method of FIG. 7.

BEST MODE FOR CARRYING OUT THE INVENTION

In the following description, for purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

Figure 1:
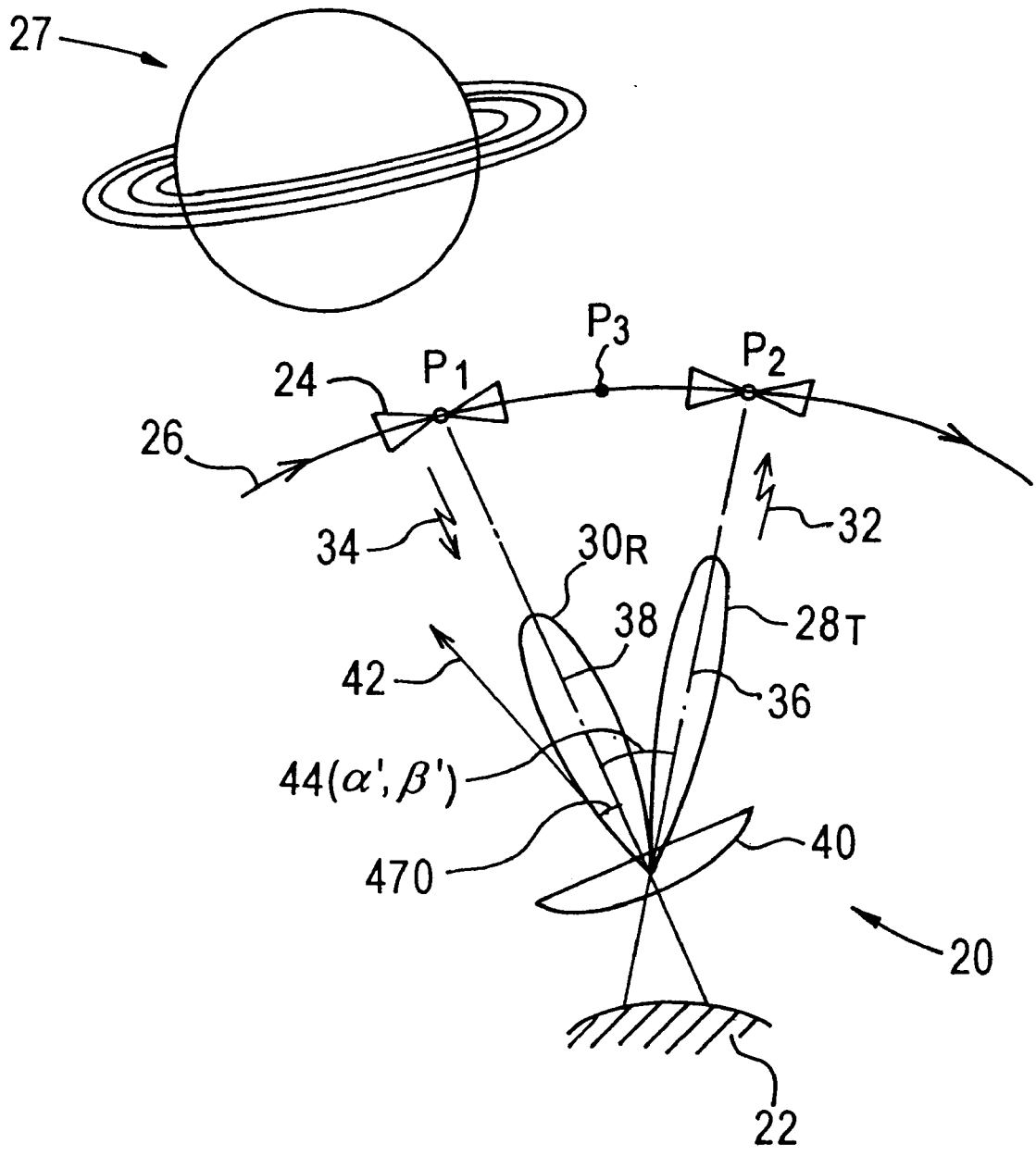
FIG. 1 is a high-level operational diagram of an embodiment of an antenna system in accordance with the present invention.

FIG. 1 is a high-level operational diagram of an embodiment of an antenna system 20 operable in accordance with the principles of the present invention. As illustrated, antenna system 20, positioned at a predetermined terrestrial location 22, tracks a spacecraft 24 along its predetermined interplanetary trajectory 26. Trajectory 26 brings spacecraft 24 into the neighborhood of a distant planet 27, e.g., Saturn—in one intended application of the present invention. Antenna system 20 forms a transmit beam 28 and a receive beam 30 for respectively transmitting an electromagnetic (EM) uplink signal 32 to and receiving an EM down-link signal 34 from spacecraft 24. Transmit beam 28 is approximately symmetrical about a beam axis 36 thereof substantially aligned with a peak gain of the transmit beam 28. Similarly, receive beam 30 is approximately symmetrical about a beam axis 38 thereof substantially aligned with a peak gain of the receive beam 30.

Antenna system 20 includes a Cassegrain high-gain antenna assembly having a large main reflector 40, e.g., thirty-five meters in diameter, and a sub-refector, not shown, aligned with an optical axis 42 of main reflector 40. In addition to a conventional beam steering mechanism, antenna system 20 advantageously includes a beam steering mechanism capable of angularly separating, i.e., angularly splitting, the receive and transmit beams 30,28 by a predetermined angle 44. Antenna system 20 is thus capable of simultaneously aligning receive and transmit beams 30,28 with a first (i.e., past) spacecraft position p1 and a second (i.e., future) spacecraft position p2 having spaced-apart RA/DEC position coordinates.

More specifically, transmit beam 28 is independently steerable in azimuth and elevation with respect to both receive beam 30 and optical axis 42 of main reflector 40, to impose angular offset or split 44 between receive and transmit beams 30,28 aligned respectively with the first and second spacecraft positions. It should be appreciated that an antenna beam is said to be aligned with, i.e., pointed at or in the direction of, the spacecraft when a peak gain of the beam is substantially aligned with the spacecraft; this occurs when the beam axis (e.g., beam axis 36 or 38) is substantially aligned with the spacecraft.

In providing independent steering of transmit beam 28 relative to receive beam 30 and optical axis 42, antenna system 20 overcomes complications associated with planetary aberration to permit effective, contemporaneous reception of down-link signal 34 from and transmission of uplink signal 32 to distant spacecraft 24 at the spaced past and future positions p1,p2, as the following brief operational example illustrates.

To provide a basic understanding of the invention the following operational example is provided and the structure which provides this functionality is described in detail following the operational example. At an instant in time corresponding to a present time, receive beam 30 is steered into alignment with past position p1 where the spacecraft was half a RTLT prior to the present time, and contemporaneously, transmit beam 28 is steered into alignment with future position p2 where spacecraft 24 will be half a RTLT after the present time—spacecraft 26 moves from past positions p1 to future position p2 in one RTLT of uplink signal 32 and down-link signal 34 between satellite 24 and antenna system 20. Down-link signal 34 transmitted by spacecraft 24 from past position p1 is received via receive beam 30. Similarly, uplink signal 32 is transmitted to spacecraft 24 at future position p2 via transmit beam 28. Angular offset or split 44 required between receive and transmit beams 30,28 arises due to planetary aberration since past and future positions p1,p2 have spaced-apart RA/DEC position coordinates; as described previously, the separation in positions arises from the relative component of spacecraft velocity orthogonal to the line-of-sight between the spacecraft and antenna system 20.

As illustrated above, antenna system 20 advantageously compensates for planetary aberration by angularly splitting receive and transmit beams to respectively align the same with respective positions p1,p2. Importantly, aligning the peak gains of the receive and transmit beams with respective positions p1,p2 also reduces detrimental effects caused by propagational attenuation of down-link and uplink signals 34,32. Such can be appreciated considering that planetary aberration can require an angular offset 44 of, for example, up to 30 millidegrees for a spacecraft travelling near Saturn, while each of high-gain receive and transmit beams 30,28 has an exemplary 3 dB beam-width (i.e., a full beam-width 3 dB down from the peak gain point of the beam) of approximately 15 millidegrees.

Figure 2:
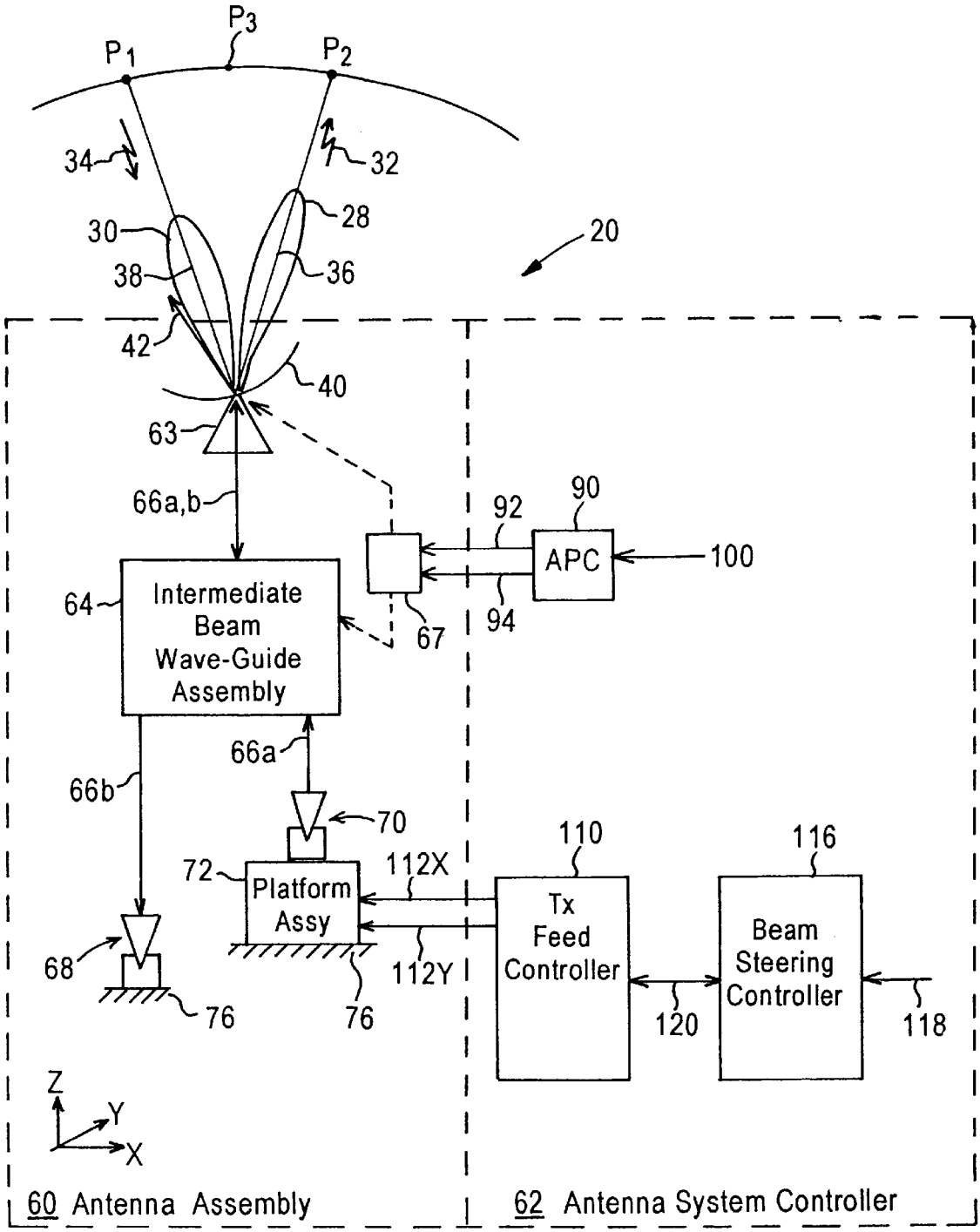
FIG. 2 is a high-level block diagram of the antenna system of FIG. 1.

With reference to FIG. 2, antenna system 20 includes an antenna assembly 60 and an antenna system controller 62. Antenna assembly 60 includes both conventional Cassegrain, beam-wave guiding optics, and improvements in accordance with the present invention, to form and direct receive and transmit beams 30,28. The conventional beam waveguide optics include a high gain, parabolic main reflector 40 rotatable in both azimuthal and elevational directions. Main reflector 40 is supported above ground by a main reflector support 63. The conventional beam waveguide optics also include an intermediate beam waveguide 64. Waveguide 64 guides both an uplink or transmit EM beam 66*a* and a down-link or receive EM beam 66*b* through antenna assembly 60 and feeds the EM beams to and from main reflector 40, respectively.

A conventional fixed receive feed 68 receives EM beam 66*b* from waveguide 64. More specifically, down-link signal 34 received via receive beam 30 is directed by main reflector 40 and optics associated therewith to intermediate beam waveguide assembly 64. Assembly 64 guides down-link signal 34 from main reflector 40 to an input aperture of receive feed 68. Conventional motors and servomechanisms, indicated generally as reference numeral 67, are coupled to main reflector 40, main reflector support 63, and moveable optical components within beam waveguide assembly 64, as will be described. Motors and servomechanisms 67 rotate optical axis 42 of main reflector 40 in both azimuthal and elevational directions responsive to a pair of respective azimuthal and elevational control signals 92,94, as is known in the art.

An improvement to antenna assembly 60 in accordance with the present invention includes a conventional moveable transmit feed 70 (described more fully later) to independently steer transmit beam 28 with respect to optical axis 42 and receive beam 30. Moveable transmit feed 70 radiates the uplink signal, i.e., EM beam 66*a*, toward intermediate beam waveguide assembly 64. Intermediate beam waveguide assembly 64 guides beam 66*a* input thereto, along an optical path within antenna assembly 60, to an output of waveguide assembly 64. Beam waveguide assembly 64 directs beam 66*a* to main reflector 40, from where uplink signal 32 is transmitted into space via transmit beam 28.

The improvement includes a platform assembly 72 for moveably supporting transmit feed 70. Specifically, a moveable upper surface or platform of platform assembly 72 supports transmit feed 70, whereas a lower surface of the platform assembly rests upon a fixed surface 76. Platform assembly 72 displaces transmit feed 70 supported thereby responsive to a pair of actuator control signals 112*x*,112*y* indicative of transmit feed displacement, and provided from antenna system controller 62, as described in detail below. As will be described more filly, an independent, controlled displacement of transmit feed 70 in a planar direction results in a correspondingly controlled angular offset between transmit beam 28 and both optical axis 42 and receive beam 30.

Antenna system controller 62 includes both conventional beam steering control components and improvements in accordance with the present invention, which work together to control antenna assembly 60. Antenna system controller 62 thus controls antenna assembly 60 to track spacecraft 24 and to compensate for planetary aberration. Conventionally, an antenna pointing controller (APC) 90 derives azimuthal and elevational control signal pair 92,94 responsive to apriori spacecraft trajectory information provided to APC 90 over an interface 100.

In accordance with the present invention, a transmit feed position controller 110 and a beam steering controller 116 together control the movements or displacements of moveable transmit feed 70. Transmit feed position controller 110 derives actuator control signal pair 112*x*,112*y* responsive to transmit feed displacement commands issued thereto over an interface 120. High-level beam steering controller 116 controls the independent beam steering of transmit beam 30 to correct for planetary aberration, and derives the transmit feed displacement commands issued to controller 110 responsive to the apriori spacecraft trajectory information supplied thereto via an interface 118. Both APC 90 and beam steering controller 116 receive a signal indicative of accurate real-time, e.g., Greenwich Mean Time (GMT), and are thus time-synchronized. Feed controller 110 is also time-synchronized with controller 116 to provide controlled, real-time displacements of transmit feed 70.

Figure 3B:
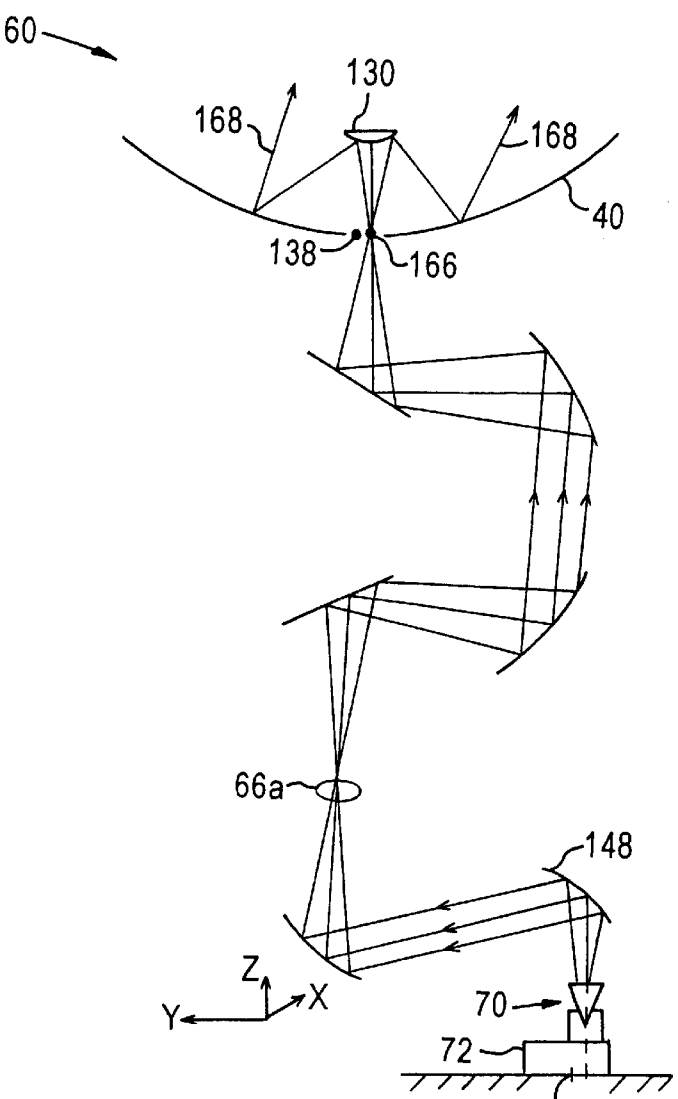
FIG. 3B is a schematic diagram of the antenna assembly of FIG. 3A with a transmit feed displaced from an origin.
Figure 3A:
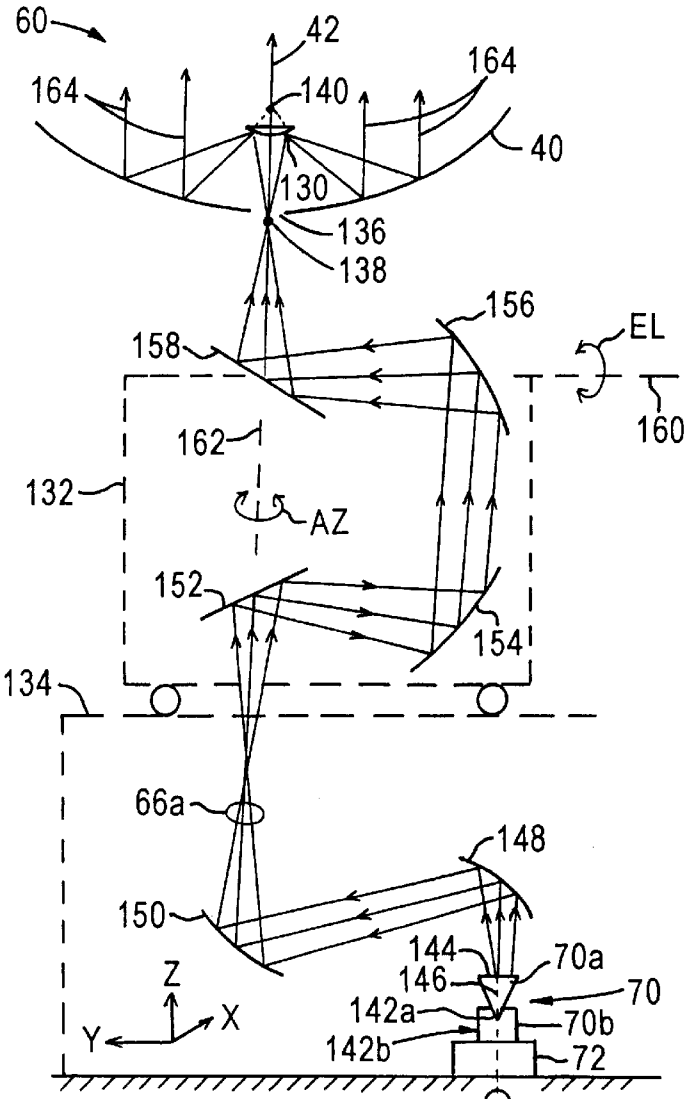
FIG. 3A is a schematic diagram of an arrangement of the beam waveguide optics of the antenna assembly of FIG. 1.

FIGS. 3A and 3B are schematic diagrams of an embodiment of a construction of the beam waveguide optics of antenna assembly 60. The conventional beam waveguide optics include parabolic main reflector 40 and a hyperbolic sub-reflector 130, both supported above an upper edifice 132. Upper edifice 132 is rotatively coupled to and above a fixed lower edifice 134. Main reflector 40 includes a central opening 136 through which beam energy is directed, and sub-reflector 130 is fixedly centered along optical axis 42 of main reflector 40. Optical axis 42 extends through both a first focus point 138 and a second focus point 140 of the combined sub-reflector 130 and main reflector 40.

Moveable transmit feed 70, located within fixed lower edifice 134, provides the source of EM beam energy for beam 66*a* in the transmit direction. Transmit feed 70 includes a transmit horn 70*a* coupled to a supporting transmit guide or feed assembly 70*b*. Transmit horn 70*a* includes an EM input 142*a*, an EM output aperture 144, and a horn shaped body between input 142*a* and output aperture 144. Output aperture 144 is centered along a central, longitudinal axis 146 of transmit horn 70*a*. Longitudinal axis 146 extends in a direction parallel with the Z-axis, as depicted in FIG. 3A.

A transmitter of antenna system 20, not shown, initially supplies uplink signal 32 to an input 142*b* of transmit guide or feed assembly 70*b*. Transmit feed assembly 70*b* couples uplink signal 32 to input 142*a* of transmit horn 70*a*. The horn shaped body of transmit horn 70*a* guides uplink signal 32 from input 142*a* to output aperture 144, from where the uplink signal is radiated, in the direction of longitudinal axis 146, toward intermediate beam waveguide assembly 64.

Intermediate beam waveguide assembly 64 is conventional, and includes optical components within both lower edifice 134 and upper edifice 132. Intermediate waveguide assembly 64 guides beam 66*a* from an input end thereof proximate aperture 144, along a path through antenna assembly 60, to an output end of the intermediate waveguide assembly proximate opening 136 of main reflector 40. Beam 66*a* exiting the output end of assembly 64 is directed through opening 136 toward a convex outer surface of sub-reflector 130, to be reflected thereby back toward an inner concave surface of main reflector 40. This inner concave surface reflects beam energy incident thereto into space as a main antenna beam, e.g., transmit beam 30, in the direction of a main beam axis, e.g., transmit beam axis 36.

Beam waveguide assembly 64 includes, in series along the direction of guided beam 66*a*, 1) a hyperbolic mirror 148 and an elliptic mirror 150 disposed within edifice 134, and 2) a plane mirror 152, an elliptic mirror 154, an elliptic mirror 156, and a plane mirror 158 disposed within edifice 132. As is known, main reflector 40, sub-reflector 130 and the mirrors of beam waveguide assembly 64 are moveable with respect to an elevational axis 160 and an azimuthal axis 162 to correspondingly steer receiver and transmit beams 30,28 in elevational and azimuthal directions.

Figure 3C:
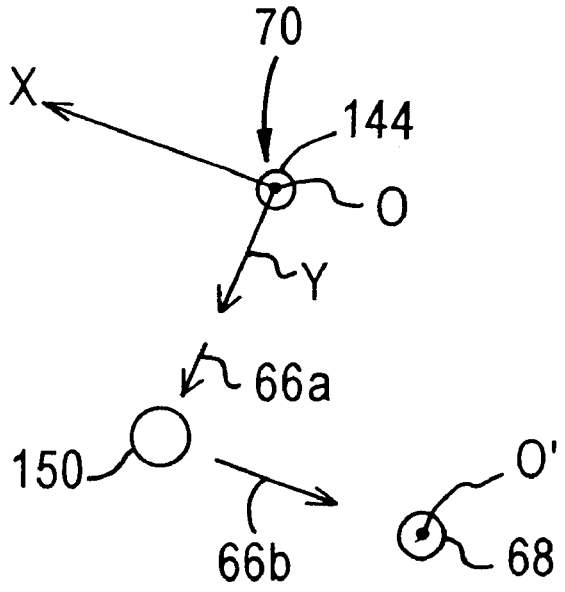
FIG. 3C is a partial plan view of the antenna assembly of FIG. 3A with the transmit feed positioned at the origin.

An important aspect of the present invention is the layout arrangement or positioning of moveable transmit feed 70 and fixed receive feed 68 with respect to mirror 150. Such is depicted in FIG. 3C—a partial plan view of antenna assembly 60 of FIG. 3A—wherein transmit feed 70 is positioned at an origin O of an X-Y plane defined by an X axis and a Y axis, and receive feed 68 is fixed at an origin O'. Transmit feed origin O is concentric with mirror 150, and the Y-axis axis is directed radially inward from origin O toward mirror 150, i.e., an inward radial displacement or movement of transmit feed 70 form origin O toward mirror 150 coincides with a positive-Y displacement of the transmit feed. The X axis is orthogonal to the Y-axis, in a conventional right-handed Cartesian coordinate system with the Z-axis directed upwardly, i.e., out of the plane of FIG. 3C. Receive feed 68 is fixed at position O', also concentric with mirror 150.

Receive and transmit beams 30,28 are aligned with optical axis 42 with receive and transmit feeds 68,70 positioned at respective origins O',O. Operationally, with longitudinal axis 146 of moveable transmit feed 70 positioned as depicted in FIGS. 3A and 3C, i.e., aligned with origin O of the X-Y plane, beam 66*a* exiting aperture 144 impinges upon a central region of mirror 148, and from there traces a centralized path through intermediate waveguide assembly 64, as indicated in FIG. 3A by the rays between mirrors. It is to be appreciated that although beam 66*a* diverges and converges along its path responsive to its interaction with the various optical components, an axis of the beam is nevertheless centralized with respect to the guiding optical components. Importantly, since beam 66*a* follows the path depicted in FIG. 3A throughout assembly 64, the beam exits the assembly in the direction of optical axis 42 and is centrally directed through first focus point 138. Main reflector 40 and sub-reflector 130 focus centralized beam 66*a* incident thereto into a main transmit beam, i.e., transmit beam 28, in the direction of optical axis 42, as indicated by rays 164.

Figure 3D:
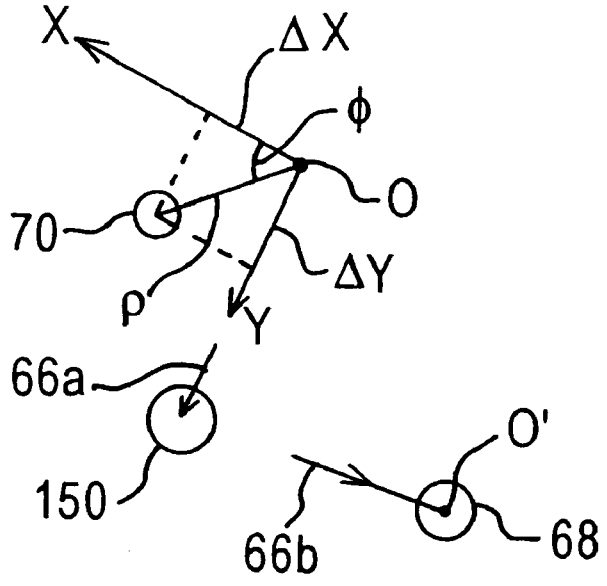
FIG. 3D is a partial plan view of the antenna assembly of FIG. 3A with the transmit feed displaced from the origin.
Figure 3E:
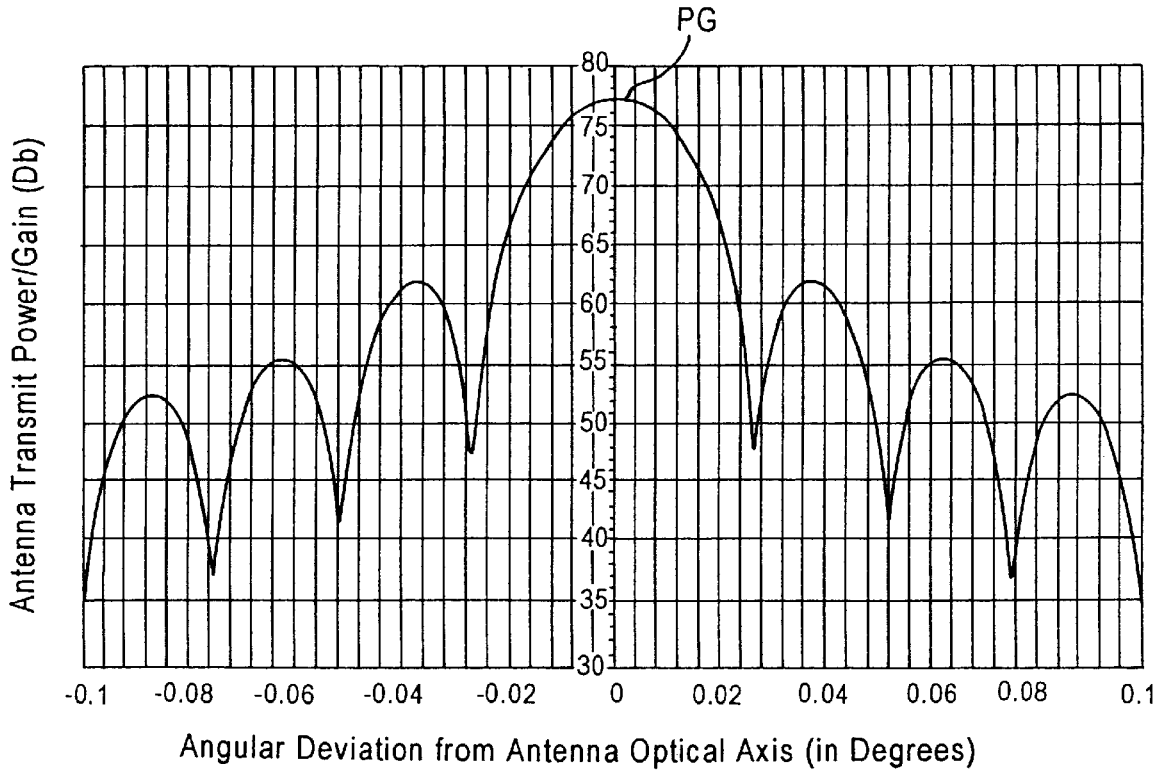
FIG. 3E is a diagram of an antenna gain pattern for the antenna assembly of FIG. 3A with the transmit feed coincident with the origin.

FIG. 3E is a plot of antenna transmit power/gain versus angular deviation from optical axis 42 for antenna assembly 20 arranged as depicted in FIGS. 3A and 3C, and operating at a transmit frequency of approximately 22 Ghz. The peak transmit gain PG plotted in FIG. 3E is aligned with optical axis 42 because transmit feed 70 is positioned at origin O, as depicted in FIGS. 3A and 3C.

Displacement of transmit feed 70 in the X-Y plane, i.e., in the X and/or Y directions, independently steers transmit beam 28 angularly away from optical axis 42 in either or both azimuthal and elevational directions. More specifically and by way of example, displacement of longitudinal axis 146 of feed 70 from origin O by an amount $\Delta X$ in the X-direction and an amount $\Delta Y$ in the Y-direction, as depicted in FIG. 3D, imposes an angular offset between transmit beam 28 and optical axis 42.

The causal effect between displacement of transmit feed 70 and angular displacement of transmit beam 30 is explained with reference back to FIG. 3B. Beam 66*a*, originating from displaced transmit feed 70, impinges upon a portion of mirror 148 correspondingly displaced from the central region thereof, and from there traces a correspondingly displaced path, i.e., displaced with respect to the centralized path of FIG. 3A, through the optical components of the beam waveguide assembly. Unlike FIG. 3A, displacement of beam 66*a* throughout assembly 64 causes beam 66*a* to exit assembly 64 displaced from first focus point 138 in the -Y-direction. Beam 66*a* is directed through a displaced beam convergence point 166, as depicted in FIG. 3B. Main reflector 40 and sub-reflector 130 generally focus displaced or offset beam 66*a* incident thereto into a transmit beam angularly offset from optical axis 42, as indicated by rays 168. The magnitude and direction of the angular offset between the main beam and optical axis 42 is a function of the magnitude and direction of the displacement of longitudinal axis 146 of feed 70 in the X-Y planar direction. In this manner, control of transmit feed displacement responsively controls the angular offset of transmit beam 28 from optical axis 42 in azimuth and elevation.

Figure 3F:
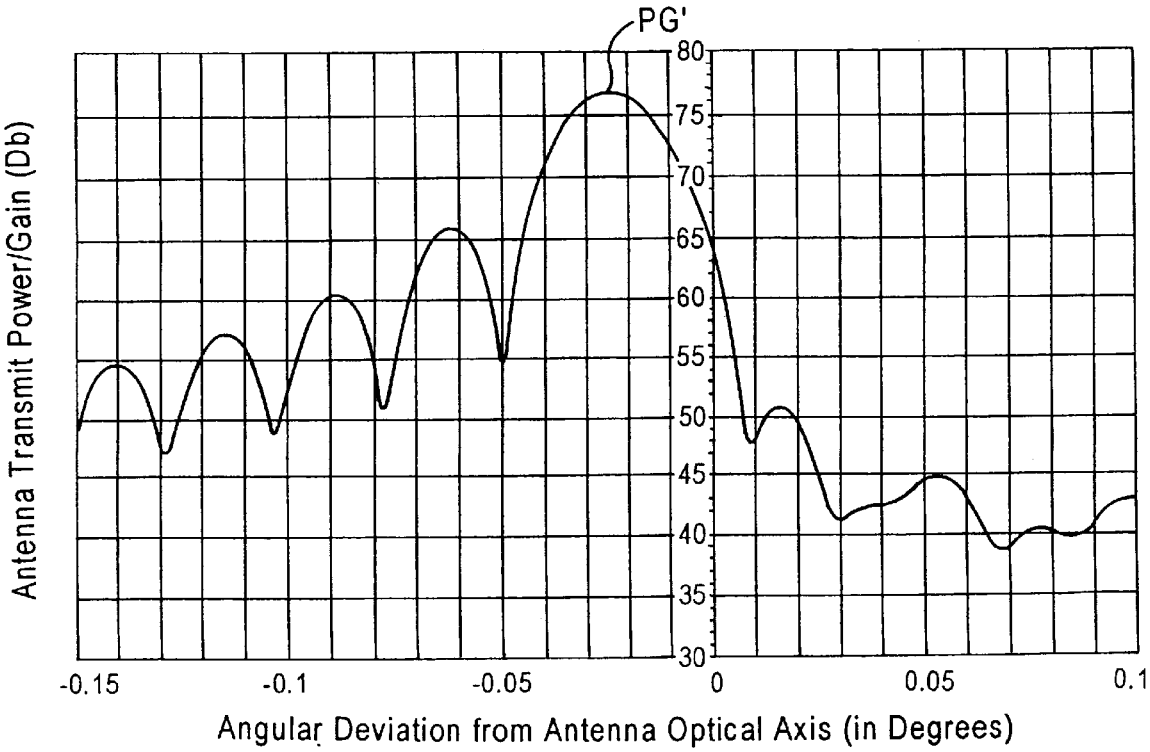
FIG. 3F is a diagram of an antenna gain pattern for the antenna assembly of FIG. 3A with the transmit feed displaced from the origin.

Another example of the above described angular offset is illustrated in FIG. 3F. FIG. 3F is a plot of antenna transmit power/gain versus angular deviation from optical axis 42 for antenna assembly 20 transmitting at approximately 22 Ghz, and arranged with transmit feed 70 offset approximately 1.66 inches from origin O in the X-direction. The 1.66 inch displacement between transmit feed 70 and origin O causes a 25 millidegree angular offset between the peak transmit gain PG' and optical axis 42, as depicted in FIG. 3F.

It is to be understood that in the beam waveguide optics of antenna assembly 60, interaction with and control of receive and transmit EM beams 66*b*,66*a* is reciprocal, i.e., the same, with respect to both the receive and transmit beam-path directions, with the exception that receive feed 68 is fixed. The receive and transmit beams trace equivalent but reverse paths through the beam waveguide optics of assembly 64, and are thus equivalently influenced thereby. With regard to the receive beam path, down-link signal 34 received by receive beam 30 from a predetermined direction, is directed by main reflector 40 and sub-reflector 130 to intermediate waveguide assembly 64. Waveguide assembly 64 in turn directs beam 66*b* from main reflector 40 to receive feed 68 positioned at O'. Receive feed 68 directs beam energy collected thereby to a receiver of antenna system 20, not shown.

In brief summary, the preferred embodiment includes moveable transmit feed 70 and fixed receive feed 68 within edifice 134 to feed the beam waveguide assembly 64. Receive beam 30 is steerable through conventional beam steering techniques previously discussed, e.g., using APC 90 and motors and servomechanisms 67 controlled thereby, whereas transmit beam 28 is independently steerable through controlled displacement of transmit feed 70. Transmit beam 28 is also steerable using the conventional technique.

Figure 4:
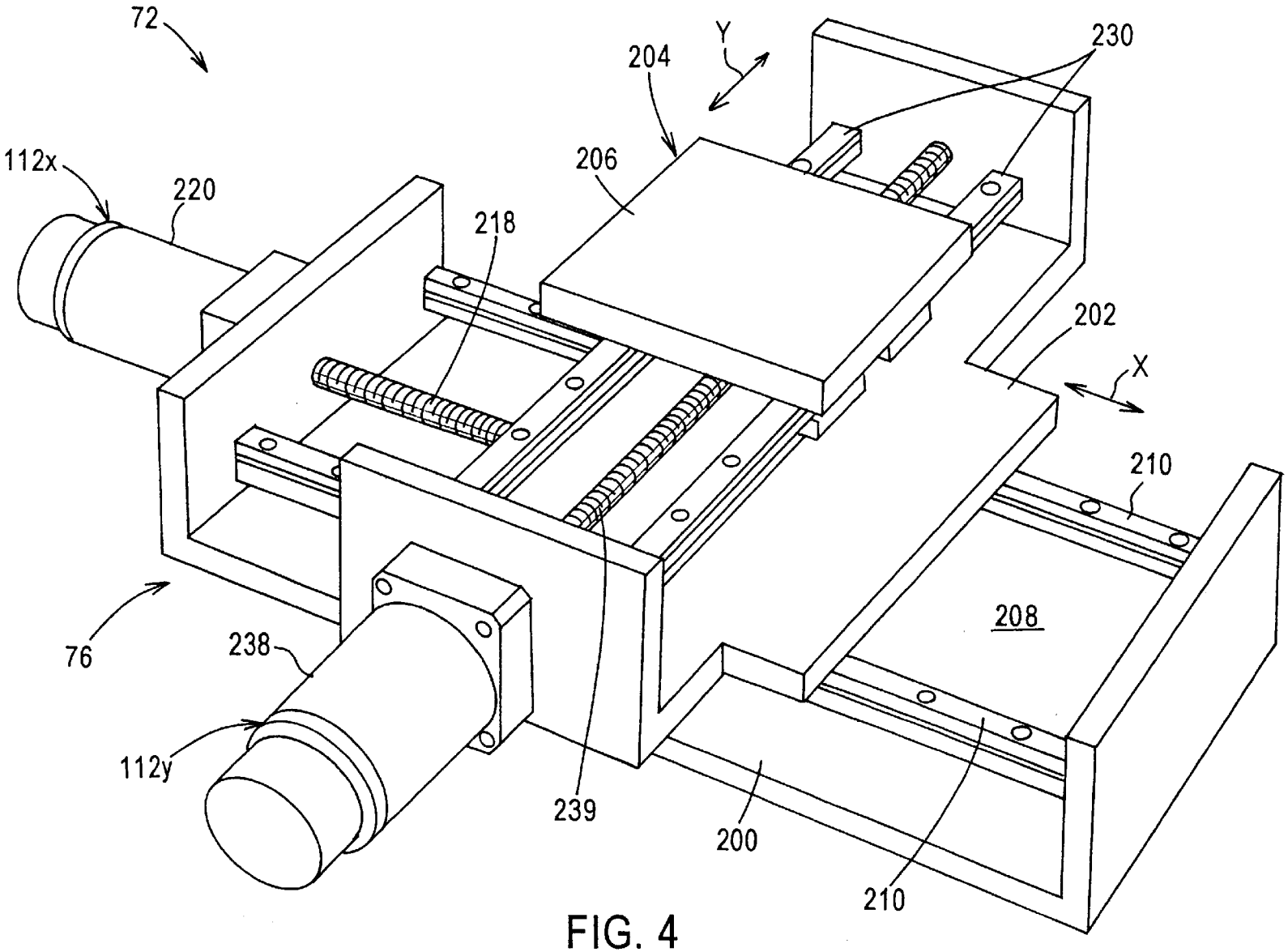
FIG. 4 is a perspective view of an embodiment of a platform assembly.

FIG. 4 is a perspective view of platform assembly 72 used to support and displace transmit feed 70. Platform assembly 72 is a commercially available product sold by, for example, Parker Hannifin Corporation located in Pennsylvania. Platform assembly 72 supports transmit feed 70 and is adapted to displace the position of transmit feed 70 in a planar direction, e.g., in the X-Y plane. Platform assembly 72 is a vertically stacked structure including a base 200 fixed or resting on surface 76. An X-translation table 202 disposed above and slidingly coupled to base 200 is displaceable in the X-direction. A Y-translation table 204 disposed above and slidingly coupled to X-translation table 202 is displaceable in the Y-direction. Transmit feed 70 is supported by an upper surface 206 of Y-translation table 204 and is displaced therewith.

An upper surface 208 of base 200 includes a pair of parallel rails 210 extending in the X direction. A set of parallel legs, not shown, depend vertically from a lower surface of X-translation table 202. The set of parallel legs slidingly engage parallel rails 210, whereby X-translation table 202 can be driven to slide in the X-direction. A first actuator assembly includes a motor 220 fixed to base 200, and a threaded rod 218 rotatably driven by motor 220. Threaded drive rod 218 is rotatably coupled to X-translation table 202, whereby X-translation table 202 is driven to slide in the X-direction responsive to a rotative displacement of threaded drive rod 218 by motor 220. Specifically, X-translation table 202 is displaced in opposing X-directions responsive to bidirectional rotative displacement of threaded rod 218 by motor 220.

Similar to the above arrangement, a pair of parallel rails 230 extending in the Y-direction are fixed relative to X-translation table 202. Y-translation table 206 is driven to slide along rails 230 by a second actuator including a motor 238 and an associated threaded rod 239 coupled to Y-translation table 204.

Actuator control signals 112*x*,112*y* are provided to respective control inputs of motors 220,238 to control the rotative displacement imparted by these motors to respective drive shafts 218,239, to thus control the displacements of respective X- and Y-translation tables 202,204. Actuator control signals 112*x*,112*y* control the number of revolutions, the angular velocity, and the angular acceleration of respective drive shafts 218,239. In this manner, actuator control signals 112*x*,112*y* control the magnitude, velocity, and acceleration of the X and Y displacements of feed 70.

Figure 5A:
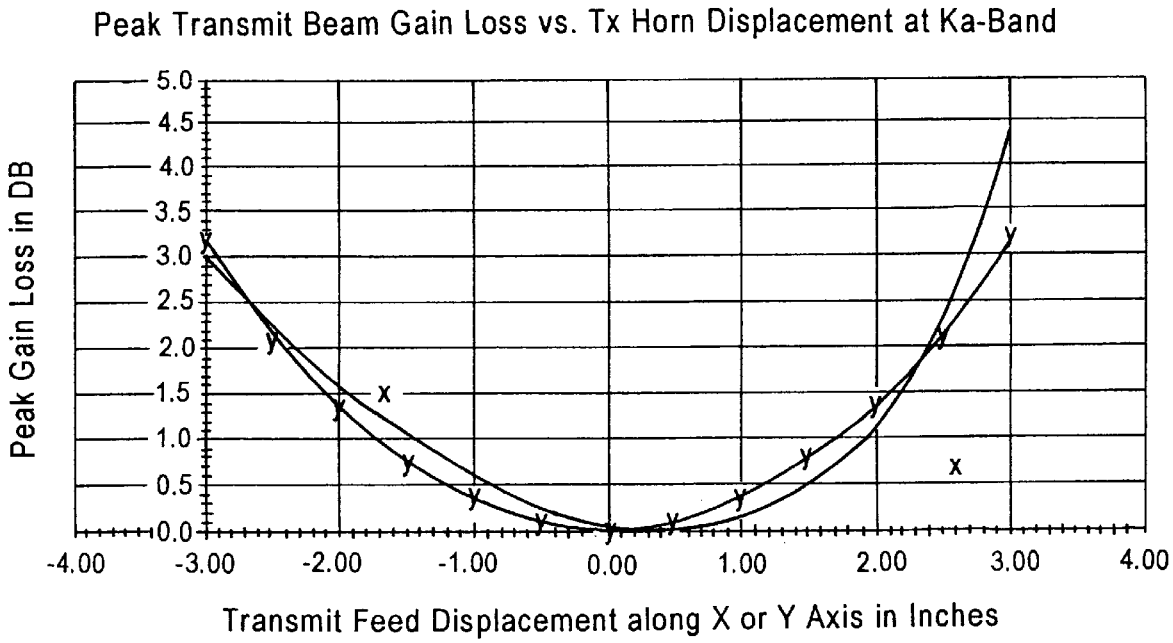
FIG. 5A is a diagram of a plot of predicted peak transmit beam gain loss versus transmit feed displacement along X and Y axes for the antenna assembly of FIG. 3A.
Figure 5B:
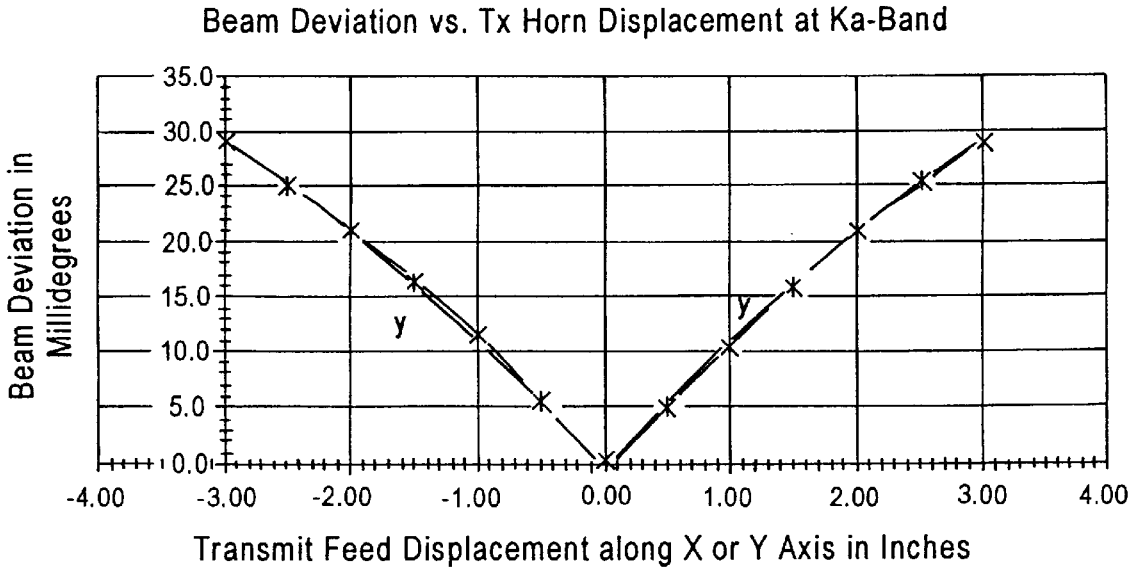
FIG. 5B is a diagram of a plot of predicted beam deviation from a reference axis versus transmit feed displacement along the X and Y axes.

FIGS. 5A and 5B are predicted performance curves for antenna assembly 20 operating at a Ka band frequency, e.g., 34 GHz, and with a main reflector diameter of 35 meters. FIG. 5A is a plot of peak transmit beam gain loss versus transmit feed displacement along the X and Y axes. FIG. 5B is a plot of beam deviation, i.e., angular displacement from a reference axis, versus transmit feed displacement along the X and Y axes. Significantly, at a beam deviation or angular displacement of twenty millidegrees, corresponding to a feed displacement of approximately two inches from origin O, peak transmit beam gain loss is less than 1.5 dB. Such performance permits the beam tracking of a distant spacecraft in the presence of planetary aberration in accordance with the present invention. For instance, transmitter power, and thus the power of the uplink signal, can be increased to compensate for the relatively small decrease in peak-gain loss of transmit beam 28 resulting from the angular displacement of the transmit beam from optical axis 42 of the antenna.

Figure 6A:
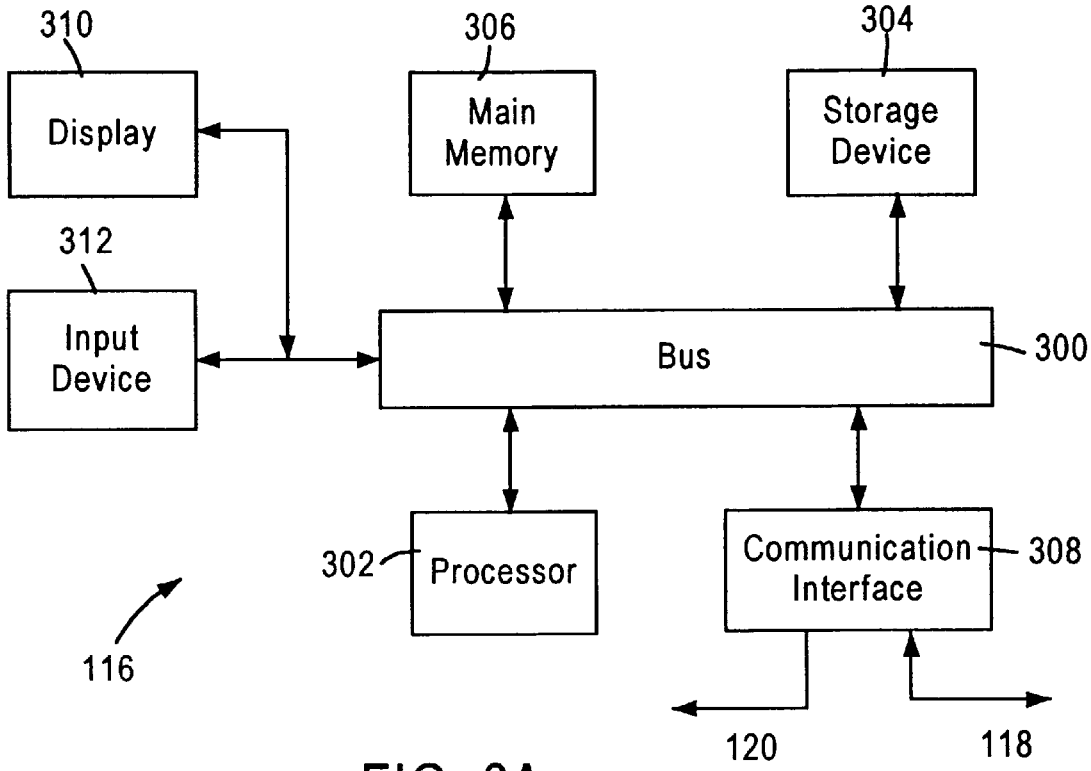
FIG. 6A is a block diagram of the beam steering controller of FIG. 2.

In antenna system 20, APC 90 and beam steering controller 116 control the beam forming/directing components of antenna assembly 60. FIG. 6A is a block diagram of an embodiment of controller 116. Controller 116 is a general purpose computer, e.g., a personal computer, as is known in the art. The controller includes a bus 300 for communicating information and a processor 302 coupled with bus 300 for processing information. A storage device 304, e.g., a disk, is provided and coupled to bus 300 for storing static information and instructions for processor 302. Controller 116 further includes a main memory 306 coupled to bus 300 for storing instructions to be executed by processor 302, and for storing the apriori spacecraft position information downloaded via interface 118. Main memory 306 is also used for storing temporary variables or other intermediate information during execution of instructions executed by processor 302.

Controller 116 includes a two-way data communication interface 308 coupled to bus 300. Communication interface 308 includes interfaces 120,118. Controller 116 includes a display 310 for displaying information, e.g., status, to antenna system operators. Operators enter information into controller 116 with an input device 312.

Processor 302 executes sequences of instructions contained in main memory 306. Such instructions are read into memory 306 from another computer-readable medium, such as storage device 304. Execution of the sequences of instructions contained in memory 306 causes processor 302 to perform various method and operational steps of the present invention. In alternative embodiments, hard-wired circuitry can be used in place of or in combination with software instructions to implement the invention.

Figure 6B:
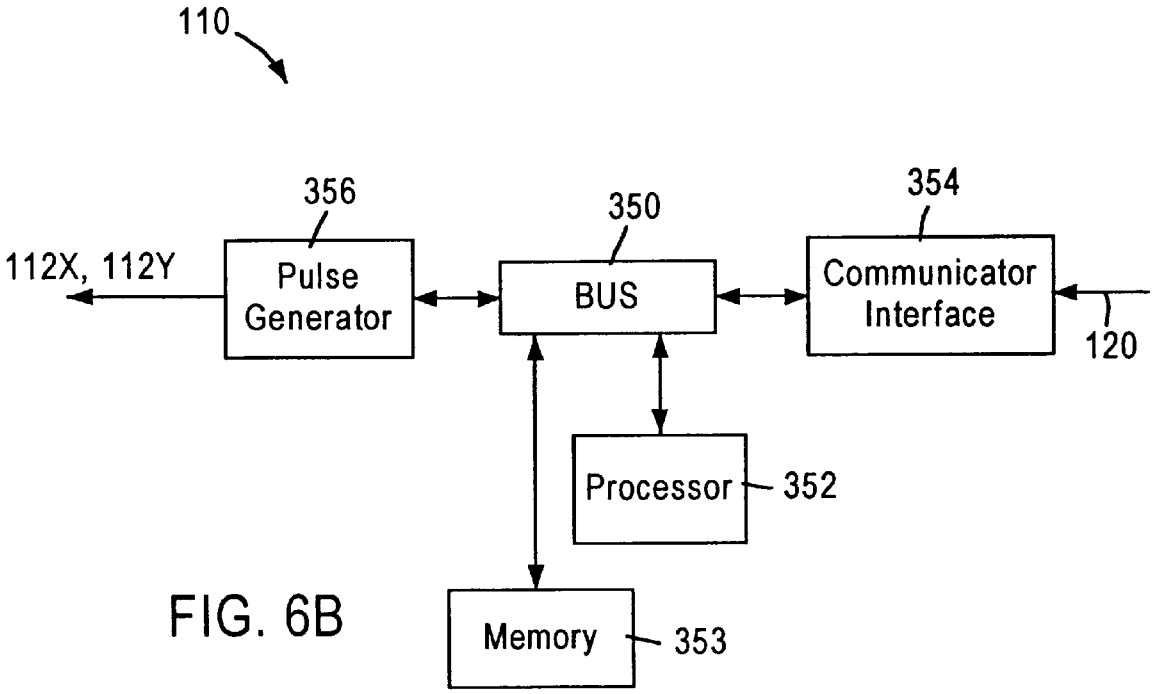
FIG. 6B is a block diagram of an embodiment of the transmit feed controller of FIG. 2.

Controller 110 directly controls the movement of transmit feed 70. An embodiment of transmit feed controller 110 is depicted in FIG. 6B. Feed controller 110 includes a bus 350 coupled with the following components: a processor 352; a main memory 353 for storing program instructions executed by processor 352; a communication interface 354 for receiving beam steering commands from controller 116; and, a pulse generator 356 for generating control signals 112*x*,112*y*. Processor 352 translates transmit feed displacement commands received via interface 120 to pulse generator commands, including displacement magnitude, velocity and acceleration commands. Processor 352 issues the pulse generator commands to pulse generator 356. Pulse generator 356 derives pulsed, actuator control signals 112*x*,112*y* in real-time responsive to the pulse generator commands issued thereto.

As mentioned above, antenna system controller 62 (FIG. 2) derives control signals and commands for controlling antenna assembly 60. Specifically, APC 90 derives antenna steering control signals 92,94 while controllers 110 and 116 derive actuator control signals and 112*x*,112*y* to control the position of transmit feed 70. The following exemplary sequence of method steps describes the derivation and application of these control signals, and the control of antenna assembly 60 to thereby compensate for planetary aberration in the beam tracking of spacecraft 24.

FIG. 7 is a high level flow diagram for controlling antenna assembly 60 to compensate for planetary aberration. At step 390, the process is started. At step 400, apriori spacecraft trajectory information corresponding to trajectory 26 is downloaded from an external source, not shown, to controllers 90,116 via respective interfaces 100,118.

Next, at step 405, controller 116 uses the apriori trajectory information to determine an apriori past position, e.g. p1, and an apriori future position, e.g., p2, corresponding to an apriori present time and an associated apriori present position, e.g., p3, using the RTLT of down-link and uplink signals 34,32 between antenna assembly 60 and spacecraft located at apriori present position p3. This preparatory step 405 can occur at any time before spacecraft 24 is actually at present position p3.

Next, at preparatory step 410, controller 116 derives an angular offset between receive and transmit beams 30,28, e.g., angular offset 44, corresponding to an alignment of receive and transmit beams 30,28 with respective past and future positions p1,p2

Next, at preparatory step 415, controller 116 translates angular offset 44 to a corresponding positional displacement of moveable transmit feed 70 from origin O. Such displacement imposes the required angular offset 44 between receive and transmit beams 30,28, when receive beam 30 is aligned with past position p1.

The next step, step 420, is a real-time step, wherein antenna system 20 steers receive and transmit beams 30,28 into alignment with respective past and future positions p1,p2 at the real-time occurrence of the present time, when spacecraft 24 is actually at the present position p3 along trajectory 26. Antenna system 20 imposes angular offset 44 between receive and transmit beams 30,28, and in doing so, aligns receive beam 30 with position p1 to receive down-link signal 34 arriving therefrom, and aligns transmit beam 28 so as to transmit uplink signal 32 in the direction of future position p2. It is to be understood that steps 400–420 are continuously repeated for positions $p_n$, $p_{n+1}$ so as to maintain alignment between receive and transmit beams 30,28 and successive respective past and future positions (e.g., p1,p2) as spacecraft 24 traverses trajectory 26. In this manner, receive and transmit beams 30,28 of antenna system 20 continuously track spacecraft 24 along trajectory 26 and continuously compensate for planetary aberration.

Figure 9:
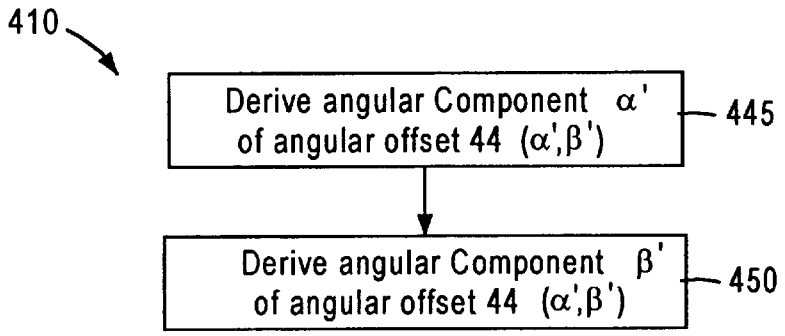
FIGS. 9–11 are flow diagrams expanding on the method steps of FIG. 7.
Figure 10:
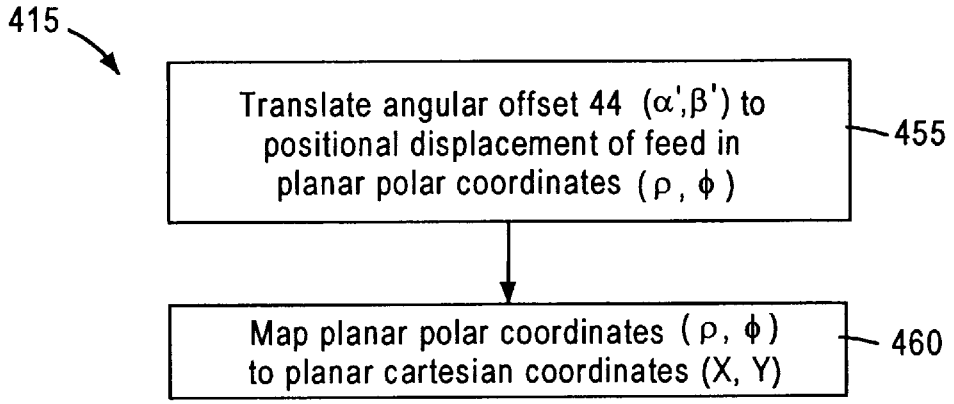
Figure 11:
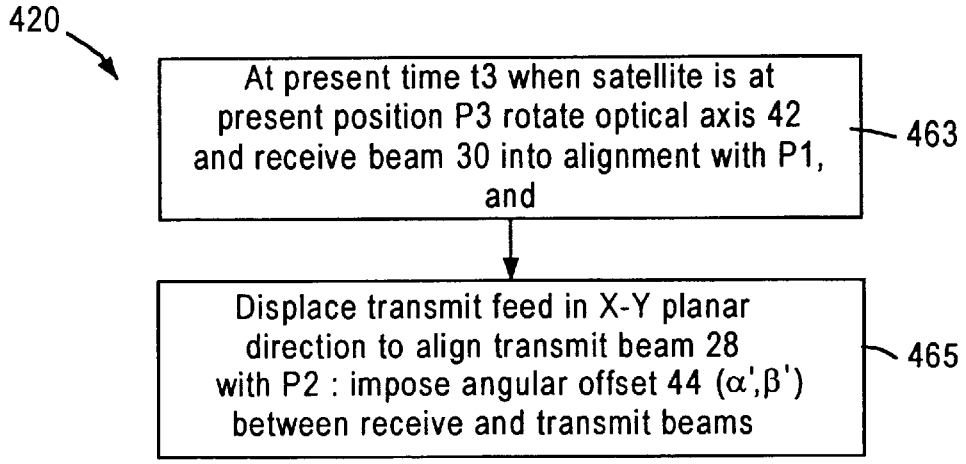

Method steps 400–420 are now explained more fully with reference to additional FIGS. 9, 10 and 11, wherein high-level method steps 410, 415, and 420 are respectively depicted in greater detail. In step 400, apriori spacecraft trajectory information is downloaded into the memories of APC controller 90 and controller 116. The apriori information is formatted to include a time-ordered list or series of successive spacecraft position entries 600 corresponding to trajectory 26 of spacecraft 24, as depicted in FIG. 8. Each of the entries includes the following:

1) an apriori (e.g., predicted) spacecraft position in AZ and EL coordinates, e.g., p1=AZ1, EL1 etc., and 2) an associated time index or time reference indicative of a predicted real-time when spacecraft 24 will arrive at the associated AZ and EL, e.g., at real-time t1, spacecraft 24 will be at position p1 (AZ1, EL1), etc.

Such information is conventional and can be downloaded to controllers 90,116 in advance or when needed thereby. Importantly, the time indexing of each of the entries permits a relatively straight forward identification of a future position once a past (or present) spacecraft position is identified. The future position is found by looking ahead in the position/time entries a predetermined amount of time. For example, once past position p1 and time index t1 associated therewith are identified, future position p2 is determined by adding the appropriate RTLT to t1, to thus establish time index t2, which is then available as an index by which associated future position p2 can be accessed. It is to be understood the positions of the spacecraft can be provided in AZ and EL coordinates, in RA/DEC coordinates, or in any other suitable coordinate system, so long as appropriate mathematical conversions there between and derivations therefrom ultimately permit the derivation of the transmit feed displacements required to align receive and transmit beams 30,28 with ascertained past and future positions p1,p2, in accordance with the present invention.

Importantly, antenna system controller 62 also uses the time indexes for real-time tracking of spacecraft 24. More specifically, since APC 90 and controller 116 are time synchronized with each other and with real-time, each controller can determine in real-time the past, present and future positions p1–p3 of spacecraft 24 corresponding to an instant in real-time by comparing the real-time to the time indexes associated with the apriori position entries.

As described above, at step 405, controller 116 identifies apriori past, future, and present positions p1(AZ1, EL1), p2(AZ2, EL2) and p3(AZ3, EL3).

At step 410, controller 116 derives angular offset 44. A pair of angular coordinates or components α', β' define angular offset 44, as illustrated in FIG. 1. Controller 116 derives angular components α', β' at respective steps 445 and 450 (FIG. 9) in accordance with the following equations:

$$\alpha'=[(\Delta EL)^2+(\Delta XEL)^2]^{1/2}$$

$$\beta'=\tan^{-1}(\Delta EL,\ \Delta XEL)$$

where $\Delta EL=EL2-EL1$, and $\Delta XEL=(AZ2-AZ1)^*\cos(ELAVG)$, and where $ELAVG=(EL1+EL2)/2$ At step 415, controller 116 translates angular offset 44(α', β') to a corresponding positional displacement of transmit feed 70 from origin O, as described previously. More specifically, at step 455 (FIG. 10), controller 116 translates or maps angular offset 44(α',β') to a corresponding positional displacement of feed 70 defined in terms of planar polar coordinates ρ, ϕ, illustrated in FIG. 3D. As depicted in FIG. 3D, The displacement of transmit feed 70 from origin O includes a magnitude ρ and a direction ϕ, defined relative to the X-axis. This translation from angular offset 44(α',β') to positional displacement ρ,ϕ proceeds in accordance with the following equations:

$$\rho=[(\Delta X)^2+(\Delta Y)^2]^{1/2}$$

where ΔX and ΔY represent displacements of transmit feed 70 in respective X and Y directions (see FIG. 3D), and $$\phi=-\beta'-(AZ-\phi_{stn})+EL+n\pi/2;\ n=-1$$

where AZ and EL represent AZ1 and EL1, and $\phi_{stn}$ is a constant depending on the location of antenna assembly 60.

At step 460, controller 116 translates transmit feed displacement ρ, ϕ into corresponding X and Y displacements ΔX, ΔY. This translation is necessary because in the preferred embodiment, p1atform assembly 72 is incrementally displaceable in X and Y directions by respective actuator assemblies thereof.

After completing preparatory steps 415–460, antenna system controller 62 has available thereto the information required to align in real-time receive and transmit beams 30,28 with past and future positions p1,p2, to thus compensate for planetary aberration. APC 90 controls real-time steering of optical axis 42, and both receive and transmit beams 30,28 therewith, while controller 116, along with feed controller 110, controls real-time independent steering of transmit beam 28. Overall, real-time synchronization existing between APC 90, controller 116, and transmit feed controller 110 permits coordinated beam steering control of receive and transmit beams 30,28 by antenna assembly 62.

Specifically, at the real-time occurrence of present time t3, i.e., at the time when down-link signal 34 arrives at antenna system 20 from the direction of past position p1, antenna system 20 performs the following steps:

1) at step 463 (FIG. 11), APC 90 steers receive beam 30 into alignment with past position p1 to receive the down-link signal arriving therefrom. Such steering requires APC 90 to drive optical axis 42 of antenna assembly 62 in azimuthal and elevational directions to bring receive beam 30 into alignment with past position p1; and 2) at step 465, transmit beam 28 is steered into alignment with position p2. Specifically, controller 116 issues a transmit feed X,Y displacement command to transmit feed controller 110. The X,Y displacement command includes the transmit feed X and Y displacements ΔX, ΔY required to impose angular offset 44(α', β') between receive and transmit beams 30,28, with receive beam 30 aligned with past position p1 (see step 463). The X,Y displacement command also includes a time entry indicative of the real-time when such displacements ΔX, ΔY must be imposed by feed controller 110. Feed controller 110 generates in real-time actuator control signals 112*x*,112*y* indicative of transmit feed displacement responsive to the X,Y displacement command. Platform assembly 72 appropriately displaces transmit feed 70 from origin O in the X-Y plane responsive to supplied actuator control signals 112*x*,112*y*, as depicted in FIG. 3D. The planar displacement thus imposed between receive and transmit feeds 68,70 correspondingly imposes angular offset 44(α', β') between receive and transmit beams 30,28, to compensate for planetary aberration.

In accordance with the present invention, antenna system 20 continuously tracks spacecraft 24 as the spacecraft moves along its trajectory 26, to compensate for planetary aberration throughout the trajectory. Accordingly, APC 90 continuously steers receive beam 30 in real-time to track successive past positions of spacecraft 24. Contemporaneously, controller 116 and feed controller 110 steer transmit beam 28 to track successive future positions of spacecraft 24, associated with the successive past positions, by continuously updating angular offset 44 (α', β'), in response to updating of displacements ΔX, ΔY of transmit feed 30. It can thus be appreciated that method steps 400–465 are repeatedly traversed to provide such continuous updating to beam track the movement of spacecraft 24 along its trajectory 26.

In practice, an angular alignment error 470 (see FIG. 1) typically arises between optical axis 42 and receive beam 28, when receive beam 28 is aligned with position p1. Angular alignment error 470 arises because of systemic errors in antenna assembly 60. At least two factors contribute to these systemic errors; imperfections in motors and servomechanisms 67 leading to imperfect steering of optical axis 42 by APC 90, and imperfections in the optical components of the beam waveguide assembly leading to an angular offset error between optical axis 42 and the direction of receive beam 30 (and transmit beam 28).

In the present invention, a bore-sighting calibration procedure quantifies angular alignment error 470, thus leading to subsequent compensation thereof. One such calibration procedure includes receive beam tracking of a distant radio source having a known location, such as a star. More specifically, APC 90 steers optical axis 42 into alignment with the positional coordinates, e.g., AZ and EL or RA/DEC, of a known star. APC 90 systematically displaces, i.e., nutates, optical axis 42 with respect the position of the known star source. A receiver (not shown), coupled to an output of receive feed 68 and to APC 90 monitors radio signal power received from the star via receive beam 30, while optical axis 42 is nutated. A maximum received signal is detected and a corresponding angular offset, e.g., angular offset 470, identified. Angular offset 470 is stored in APC 90 memory as an angular alignment error, i.e., adjustment factor, for use during subsequent tracking of spacecraft 24. APC 90 applies the adjustment factor as necessary throughout method steps 400–465 to fine tune the alignment of receive and transmit beams 30,28 with respective positions p1,p2. For example, at step 463 APC 90 steers receive beam 30 into calibrated alignment with position p1 by incorporation of the adjustment factor into AZ and EL control signal pair 92,94.

An antenna system for and method of compensating for planetary aberration in the receive and transmit beam tracking of a spacecraft has been described. Advantageously, receive and transmit beams formed by the antenna system are angularly separated or split to contemporaneously align the receive and transmit beams with separated past and future positions of the satellite. By concurrently aligning the peak gains of the receive and transmit beams with respective down-link and uplink signals transmitted between the antenna system and the spacecraft, the antenna system advantageously reduces the effect of propagational attenuation of such signals.

While there have been described and illustrated specific embodiments of the invention, it will be clear that variations in the details of the embodiments specifically illustrated and described may be made without departing from the true spirit and scope of the invention as defined in the appended claims.

What is claimed is:

1. A method of controlling a terrestrial antenna system to compensate for planetary aberration, comprising:

aligning a receive beam of the antenna system at a present time with a past position of a spacecraft; and aligning a transmit beam of the antenna system with a future position of the spacecraft spaced from the past position, wherein a down-link signal and an uplink signal can be simultaneously received from the past position of the spacecraft and transmitted to the future position of the spacecraft by the antenna system, respectively.

2. The method of claim 1, wherein the down-link and uplink signals travel round-trip between the spacecraft and the antenna system in a round-trip light travel time (RTLT), the past position of the spacecraft coincides with a past time half a RTLT before the present time, the future position coincides with a future time half a RTLT after the present time, and an angular displacement between the receive and transmit beams is caused by planetary aberration.

3. The method of claim 2, further including the steps of aligning the receive beam with the past position of the spacecraft by rotating an optical axis of the antenna system, and angularly displacing the transmit beam from the receive beam by an amount equal to said angular displacement to align the transmit beam with the future position.

4. The method of claim 3, wherein said step of angularly displacing includes the step of displacing in a planar direction the transmit feed of the beam waveguide assembly from a positional origin of the transmit feed to cause said angular displacement of the transmit beam.

5. The method of claim 4, wherein the step of displacing in a planar direction includes the step of displacing the transmit feed in a planar direction with respect to a position of a fixed receive feed of the beam waveguide assembly.

6. The method of claim 4, further including the preparatory step of deriving said angular displacement between said receive and transmit beams using apriori spacecraft position information including predictions of the past and future positions and predicted times associated therewith.

7. The method of claim 6, further including the preparatory step of deriving said planar displacement of said transmit feeds responsive to said step of deriving said angular displacement.

8. The method of claim 7, wherein said step of deriving a planar displacement includes the step of deriving said planar displacement in planar polar coordinates.

9. The method of claim 8, further including the step of translating said planar polar coordinates to planar orthogonal coordinates.

10. The method of claim 8, further including the steps of generating at least one actuator control signal indicative of said planar displacement and supplying the actuator control signal to an input of an actuator coupled with the moveable transmit feed for imparting said planar displacement to said moveable transit feed.

11. The method of claim 10, wherein said step of generating at least one actuator control signal includes the step of generating first and second actuator control signals indicative of respective first and second orthogonal displacements of said moveable transmit feed.

12. The method of claim 1 including the step of continuously aligning the receive and transmit beams respectively with successive pairs of the past and future positions as the spacecraft follows the spacecraft trajectory.

13. A method of compensating for planetary aberration in an antenna system, said antenna system including a beam waveguide and a transmit feed for forming and directing a transmit beam, the transmit beam being adapted to transfer a signal between said transmit feed and a spacecraft, comprising:

angularly displacing the transmit beam from an optical axis of the beam waveguide responsive to a displacement of the transmit feed in a direction orthogonal to an axis of the transmit feed, to align the transmit beam with a future position of the spacecraft, the spacecraft moving from a present position to the future position during the approximate time taken for the transfer of the signal between the antenna system and the spacecraft.

14. An antenna system controller for a terrestrial antenna, the terrestrial antenna being adapted to form and direct transmit and receive beams for respectively transmitting a signal to and receiving a signal from a spacecraft, comprising:

a processor;

an interface coupled to said processor; and a memory coupled to said processor, said memory having stored therein sequences of instructions which, when executed by said processor, causes said processor to:

identify temporally spaced first and second apriori positions of the spacecraft corresponding to a round-trip travel time of the signals between the spacecraft and the terrestrial antenna; and derive an angular displacement between the receive and transmit beams to contemporaneously align the receive and transmit beams with spacecraft positions.

* * * * *